United States Patent [19]

Coupar

[11] Patent Number: 4,750,742

[45] Date of Patent: Jun. 14, 1988

[54] MODIFIED ONE-SPAN STRINGING RACQUET AND METHOD OF STRINGING

[76] Inventor: Robert B. Coupar, 4906 Prospect Lake Road, R.R.#7, Victoria, British Columbia, Canada, V8X 3X3

[21] Appl. No.: 875,439

[22] Filed: Jun. 17, 1986

[51] Int. Cl.[4] ..... A63B 49/02; A63B 51/14

[52] U.S. Cl. ..... 273/73 D; 273/73 A; 273/73 C

[58] Field of Search ..... 273/73 R, 73 A, 73 B, 273/73 C, 73 D, 73 E, 73 H, 73 L, 73 K; 269/45, 71

[56] References Cited

U.S. PATENT DOCUMENTS

| | | | |
|---|---|---|---|
| 1,962,701 | 6/1934 | Andrews | 273/73 E |
| 3,642,283 | 2/1972 | Wilkens | 273/73 G |
| 3,834,699 | 9/1974 | Pass | 273/73 C X |
| 3,977,662 | 8/1976 | Cook | 269/71 |
| 4,125,259 | 11/1978 | Halbrook | 273/73 A |
| 4,140,316 | 2/1979 | Coupar | 273/73 D X |

FOREIGN PATENT DOCUMENTS

WO85/00114 1/1985 PCT Int'l Appl. ..... 273/73 E

*Primary Examiner*—Richard C. Pinkham
*Assistant Examiner*—Matthew L. Schneider
*Attorney, Agent, or Firm*—Townsend and Townsend

[57] ABSTRACT

A racket comprised of a frame connected to a handle wherein the frame has a retaining channel that extends around its outer periphery. The frame also has a plurality of holes extending therethrough for receiving individual strings. Slidable within the retaining channel are a plurality of retaining members that have recesses in their end portions. The recesses serve to define string holes when the retaining members are placed together. Each of the strings has a portion of increased extent at each end such that the strings can be passed through the frame hole while at the same time being secured to the frame by way of the string holes on the retaining members. Since the string holes in the retaining members are smaller in size than the portion of the string of increased extent, the strings are held in place in the frame.

15 Claims, 4 Drawing Sheets

MODIFIED ONE-SPAN STRINGING RACQUET AND METHOD OF STRINGING

FIELD OF THE INVENTION

This invention relates to racquets and more particularly to one span stringing for racquets.

DESCRIPTION OF THE PRIOR ART

U.S. Pat. No. 4,140,316 which issued on Feb. 20, 1979 to Robert B. Coupar discloses an apparatus and a method for stringing a racquet with a plurality of strings, each string spanning the racquet frame once.

With conventional racquet stringing systems, string spans are mostly of different lengths and although the strings are kept under the same tension the string response will vary to some extent from span to span. An overall loosening of strings and a corresponding drop in tension also occurs during play as strings settle and adjust around the frame. A player using the one span method and apparatus disclosed in applicant's U.S. Pat. No. 4,140,316 in conjunction with the racquet modified as described herein will be able to secure strings at any required tension. Since main strings are all of equal length, as are all cross strings, each span will offer the same response and accordingly a larger sweet spot will be obtained. Also, the use of this modified racquet will permit a greater concentration of strings requiring less tension on each string while offering greater efficiency. A lower tension on each string will also result in fewer broken strings. As described in applicant's U.S. Pat. No. 4,140,316, a broken string requires only the replacement of one span and this can be done immediately in a few minutes without the need for a professional stringer or stringing machine.

It is therefore an object of the present invention to provide a racquet having a rectangular frame which will permit the use of main strings of equal length and the use of cross strings of equal length as well.

Another object of the present invention is to provide a racquet having a square frame which will permit the use of main and cross strings of equal length.

Another object of the present invention is to provide a racquet which will allow the player to apply the same tension to each main string and cross string.

Another object of this invention is to provide a racquet with a larger sweet spot than is provided in conventional oval shaped racquets.

Yet another object of this invention is to provide a racquet with a novel string retaining design.

SUMMARY OF THE INVENTION

According to one aspect of this invention, there is provided a racquet having a plurality of strings, each string having a portion of increased cross-sectional extent near each end, a frame and a handle, said frame having a plurality of apertures extending therethrough each aperture having a cross-sectional extent generally the same as said portion of strings, each string being secured to the frame at two ends, the portions of the strings of increased extent being located outwardly from the apertures of said frame, the improvement comprising retaining channel means on said frame for allowing string retainers to be secured to said frame, said string retainers having a recess means wherein said recess means, when said string retainers abut each other, in said channel means, form an aperture smaller in cross section than said portion of increased cross-sectional extent such that said string retainers prevent said portions of said strings from passing through the aperture of said frame.

According to another aspect of this invention there is provided a method of stringing a racquet having a plurality of strings, each string having a portion of increased cross-sectional extent near each end, a frame and a handle, said frame having a plurality of apertures extending therethrough each aperture having a cross-sectional extent generallv the same as said portion of strings, comprising: providing means for measuring the distance between said portions for a required tension; tying a knot near each end of the string to provide the portions of increased cross-sectional extent, the knots being spaced apart so that the string will have the required tension when positioned on the frame; providing retaining channel means on said frame for allowing string retainers to be secured to said frame, said string retainers having recess means; abutting a number of string retainers in said channel means such that said recess means form an aperture smaller in cross section than said portion of increased cross-sectional extent thereby preventing said portion of strings from passing through the aperture of said frame; providing means for preventing a first end of said string from passing through a first aperture of said frame; pulling a second end of said string outwardly with a winch in position connected to a short length of string extending from the portion of increased extent near the second end.

DRAWINGS

The invention will now be described in conjunction with the accompanying drawings, in which.

Figure 1:
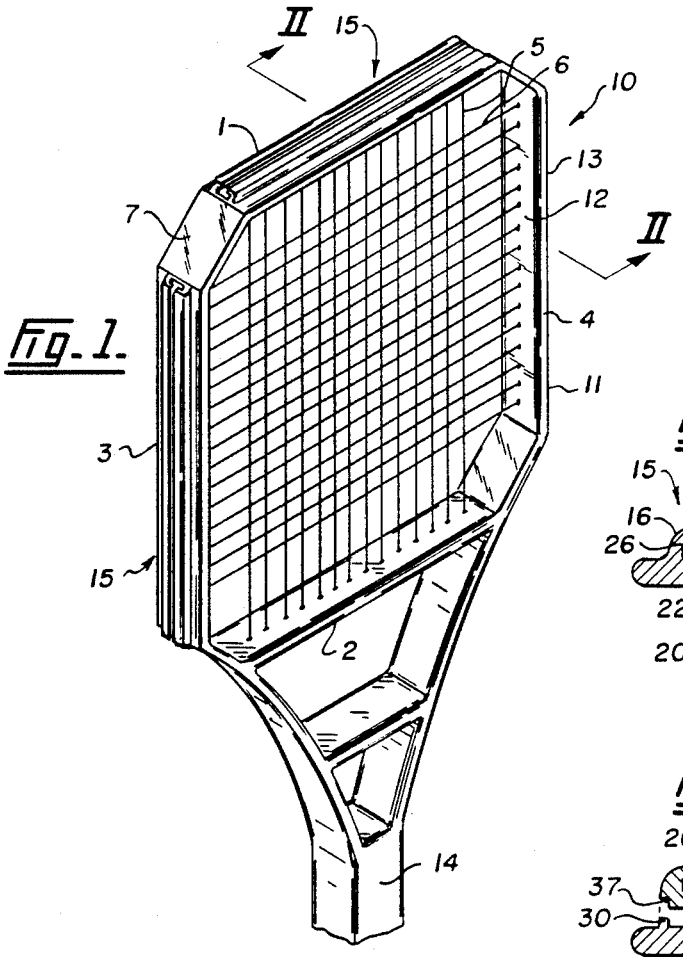
FIG. 1 is a perspective view of the racquet according to an embodiment of the invention.
Figure 2:
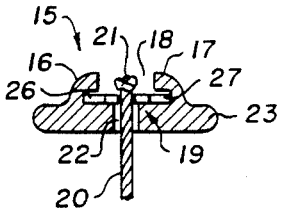
FIG. 2 is a sectional view taken along line II—II of FIG. 1.
Figure 4A:
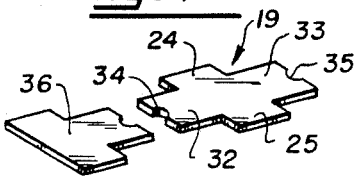
Figure 4B:
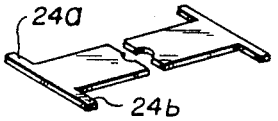
Figure 4C:
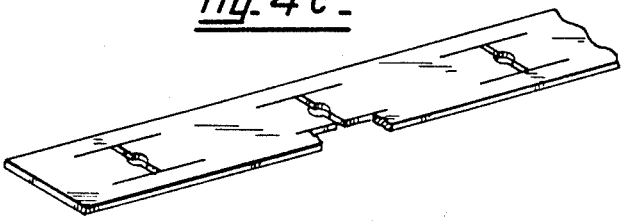
Figure 5:
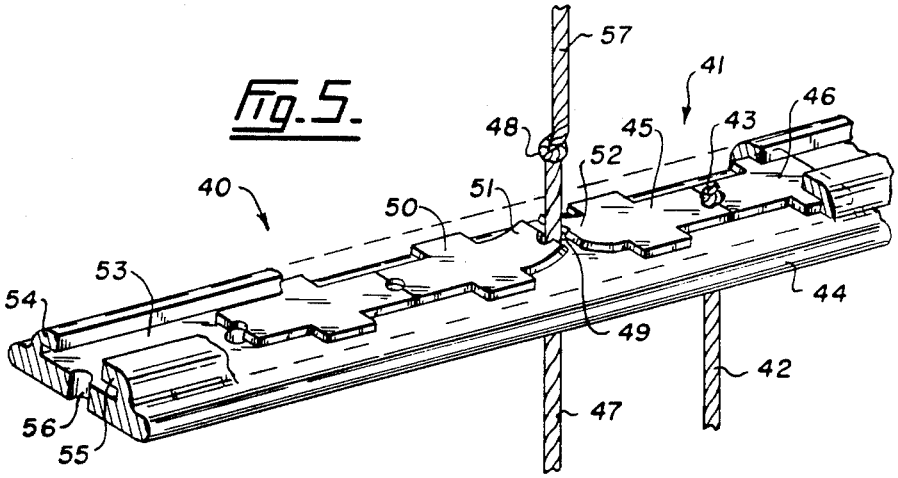
Figure 6:
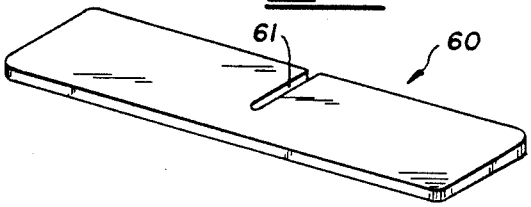
Figure 7:
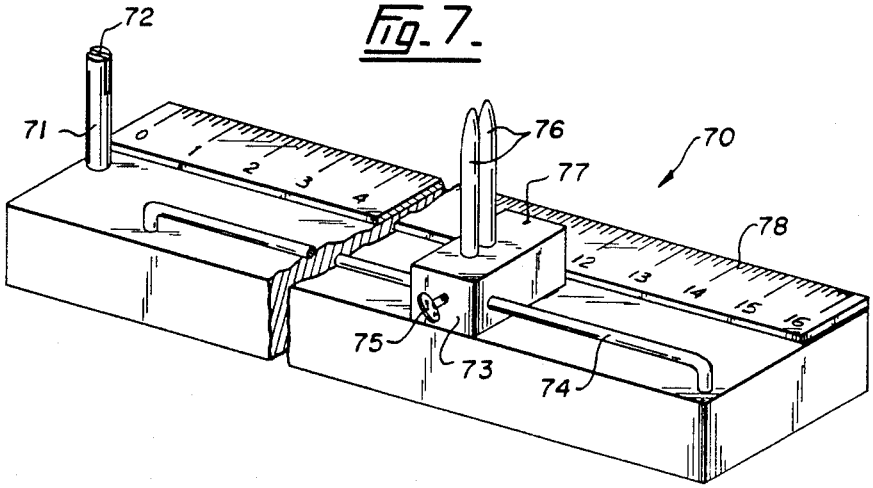
Figure 8:
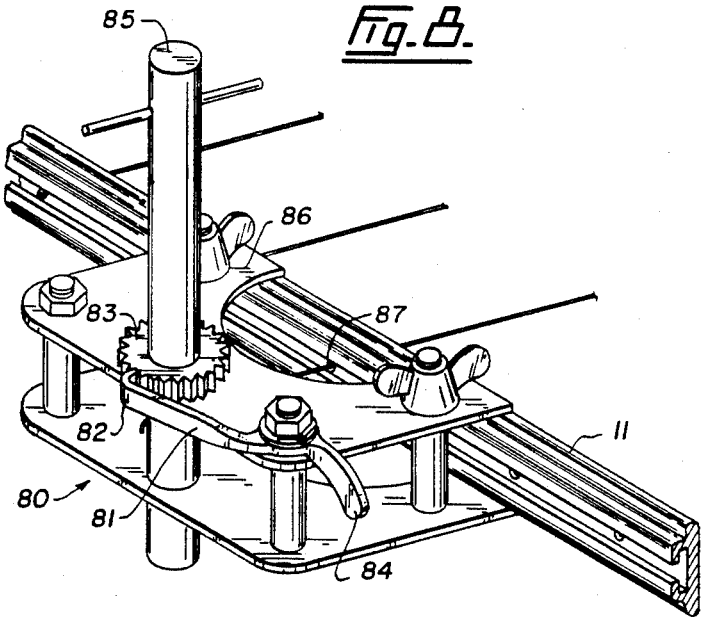
Figure 9:
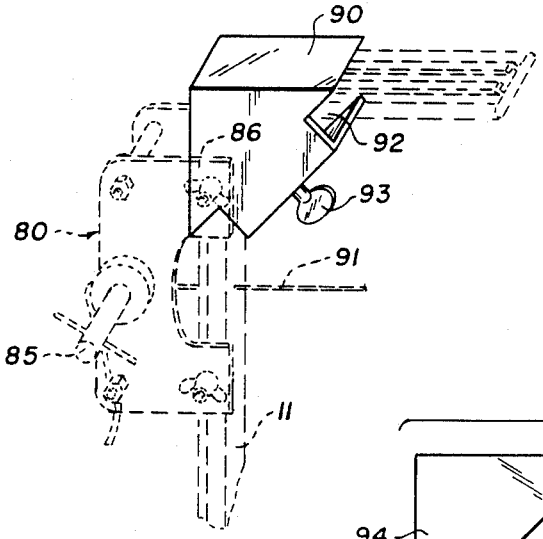
Figure 10:
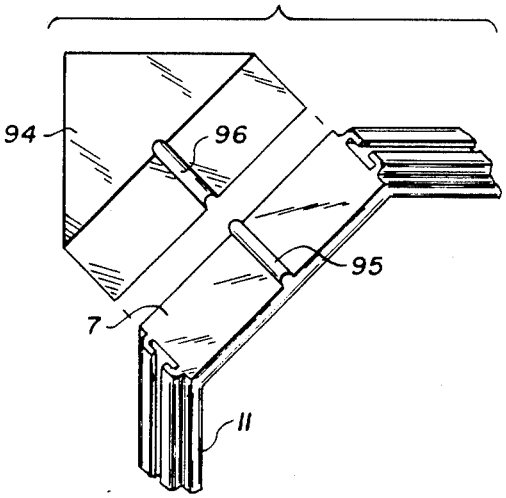
Figure 11:
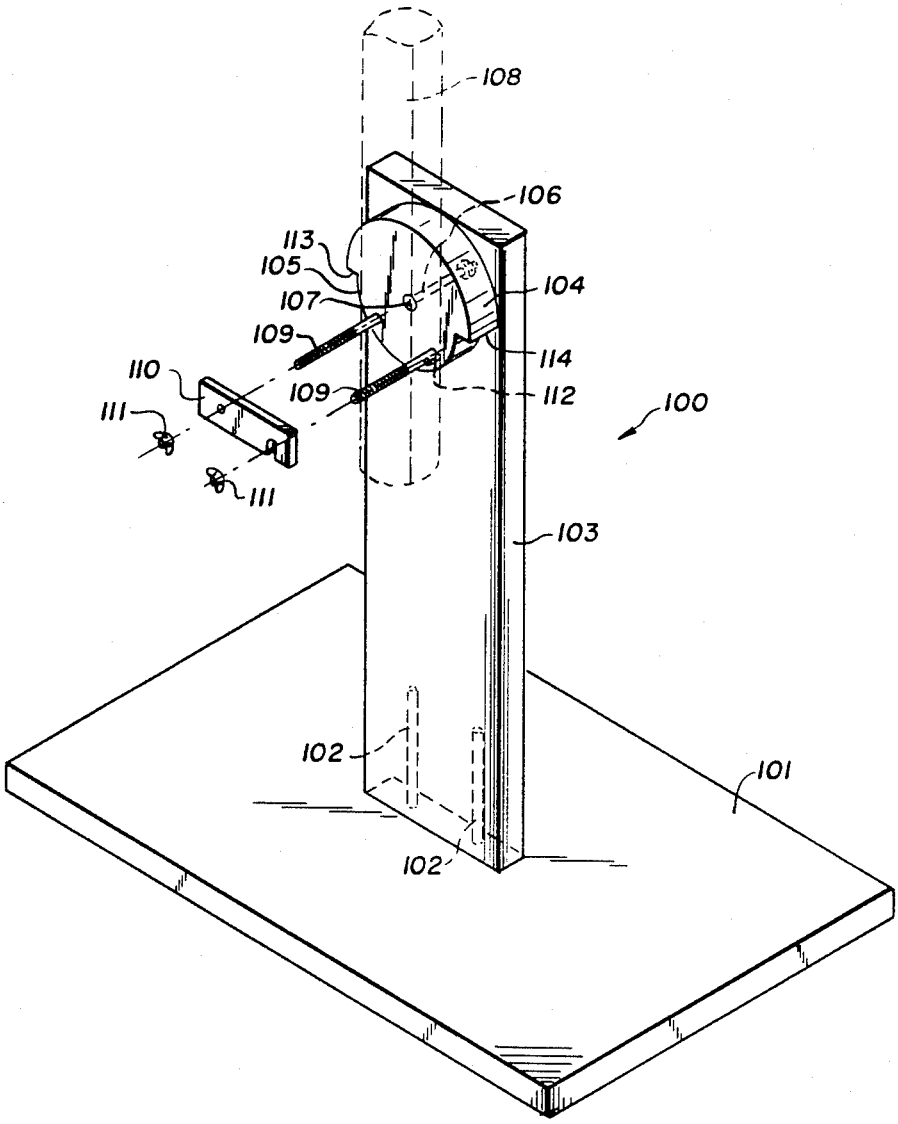

FIGS. 4*a*, 4*b* and 4*c* are isometric views of various string retainers according to the present invention;

FIG. 5 is an illustrative cross-sectional view of the modified frame shown in FIGS. 1 and 2;

FIG. 6 is an illustrative view of a knot puller;

FIG. 7 is an isometric view of a string gauge;

FIG. 8 is a perspective view of an apparatus for stringing a racquet frame according to an embodiment of this invention;

FIG. 9 is a perspective view of an apparatus for stringing a racquet frame according to another embodiment of this invention;

FIG. 10 is another embodiment of the corner block shown in FIG. 9;

FIG. 11 is an isometric view of stringing rack according to another embodiment of the invention.

DESCRIPTION OF THE PREFERRED EMBODIMENTS

Referring now to FIG. 1 we have shown at reference numeral 10 a racquet which consists of a frame 11 with an inside 12, an outside 13 and a handle 14. The frame is comprised of straight upper and lower members 1 and 2, respectively and straight side members 3 and 4. The frame can accordingly have a rectangular or square shape design depending on the relative size of the frame members. Corners 7 can either be flat as shown in FIG. 1 or rounded. This frame has been modified by the addition of retaining channel means 15 to each side members 3 and 4 and top frame member 1. Although, in the preferred embodiment, bottom frame member 2 does not use a similar retaining channel means, frame 11 could be modified to permit the use of the retaining channel means. A rectangular shaped frame allows the use of main strings 5 of equal length and cross strings 6 of equal length as well. If a square frame is used, then all strings will be of equal length each having the same tension and corresponding response to provide a larger "sweet spot" area.

As will be described below, the retaining channel means 15 provide a novel means of securing strings under tension to a racquet frame. The retaining channel means 15 can either be an integral part of the frame, as shown in FIG. 2, or separated from the frame as shown in FIG. 3.

The racquet frame shown in FIG. 1 has been somewhat enlarged for the purpose of illustrating the general shape of the frame 11 and retaining channel means 15. A more realistic frame configuration is shown in FIGS. 2 and 3.

Referring now to FIG. 2, the retaining channel means consists of a pair of retaining ridges 16 and 17 which extend from the frame of the racquet to form an open channel 18 through which can be inserted a knot retaining device 19 which will keep the required tension on string 20 by preventing knot 21 from being pulled through aperture 22 of frame 23. The size of string 20 and knot 21 appear in the drawing somewhat larger than it would be in reality. Knot 21 would in fact be smaller and well within open channel 18 thereby being protected from scuffing during play when the racquet hits the surface.

Figure 3:
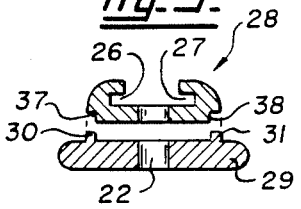
FIG. 3 is a sectional view of a modified frame according to another embodiment of the invention.

In the embodiment shown in FIG. 3, the retaining channel means 28 can be made removable from frame member 29 when the retaining channel means 28 needs to be replaced, for example, after being damaged during play. The channel means is secured to the frame 29 by the use of upstanding ridges 30 and 31 which will fit into grooves 37 and 38, respectively, and prevent the movement of channel means 28 on frame 29. String tension on channel means 28 will be sufficient to retain the channel means in place on frame 29.

Referring now to FIGS. 4*a*, 4*b* and 4*c*, the knot retaining device 19 can be made of thin pieces of flexible material shown in FIG. 4*a* and having sufficient strength to retain and support a knot under tension. The wider portions 24 and 25 of the device will fit within channels 26 and 27 of the retaining channel means, as shown in FIG. 2.

Knot retainer 19 includes extended ends 32 and 33 each having a recess 34 and 35 respectively. An aperture, of cross-sectional extent, smaller than a knot, is formed upon sliding, within a retaining channel, two knot retaining devices adjacent each other, such as shown in FIG. 4. The extended ridges 16 and 17, as shown in FIG. 2 retain the knot retaining device 19 by holding the device at its wider portions 24 and 25. These ridges, also protect the knot 21 from being damaged during play. Knot retaining device 36 can be used in corners 7 of the retaining channel means to properly secure end strings at the perimeter of the frame. A number of these, when positioned end-to-end, could also be used instead of knot retaining devices 19 as is shown in FIG. 4*b*.

Similarly, FIG. 4*b* shows string retainers similar to retainer 36 shown in FIG. 4*a* but having thinner retaining portions 24*a* and 24*b*. These basically act like axles upon which the retainer rotates as a knot is pulled through. This type of retainer does not need to be made of flexible material. Also, it allows holes to be closer together for greater concentration of strings as set out herein. In designs where holes are only approximately ½ inch apart for example the design will make it easier to string a racquet.

FIG. 4*c* shows another type of string retainer. In this embodiment the string retainers form an integral one piece strip which extends along the full length of the frame side and top members and can be more easily installed than individual retainers.

If we now refer to FIG. 5, we have shown at 40 a partially sectioned view of the modified frame shown in FIGS. 1 and 2. As depicted generally at 41, a string 42 having a knot 43 is shown in a position at which the knot has already been pulled through a string hole (not shown) of frame 44 and through an aperture (not shown) formed by knot retaining devices 45 and 46. The top end 57 of string 47 is attached to a winch (see FIG. 8) such that knot 48 can be pulled through an aperture 49 formed by knot retaining devices 45 and 50. Upon pulling knot 48 through aperture 49, bending occurs at ends 51 and 52 of knot retaining devices 50 and 45 respectively to allow passage of knot 48 through aperture 49. Ends 51 and 52 will be permitted to bend outwardly inside the opening 53 of the retaining channel and between ridges 54 and 55. Knot 48 is then lowered, by means of the winch, over the abutting retainers 45 and 50 which will hold the knot in place. The stringing procedure will be further described below.

This modified racquet is strung by using the devices shown in FIGS. 6, 7, 8, 9 and 11.

A knot pull such as shown at 60 in FIG. 6 is used to apply tension to a newly formed knot. This is achieved by simply inserting the knotted end of the string into slit 61 and pulling the string using a pair of pliers or other suitable means to tighten a knot.

This step in the process of stringing the racquet becomes important when tension is applied to a string since an untightened knot may slip thereby giving an inaccurate tension to a string which has been pre-measured.

The procedure of applying tension to tighten knots pre-stretches the string and greatly eliminates the problem of loss of tension to an installed string currently faced by racquet stringers when a string is not pre-stretched. When stringing a conventional type racquet, by means of a stringing machine, the machine or stringer may lack the means of pre-stretching the string thereby, resulting in an overall loss of string tension that follows once the string settles around the frame after being used. A string gauge 70 gives the setting required for a given string tension.

The string gauge 70 consists of a rigid post 71 having an opening 72 to secure a string at its knot. A sliding block 73 is movable on a fixed rod 74 and can be locked in position by tightening lock screw 75 placed on block 73. A pair of cone shaped pins 76 is used to secure the other end of the string to be measured. A dot 77 is used as a marker to indicate the position of block 73 with respect to a tension guide 78.

The tension guide 78 assures that the same tension will be applied to all strings once the racquet is strung.

A string winch 80, illustrated in FIG. 8, is employed for tensioning the strings.

A similar winch design has been described in applicant's U.S. Pat. No. 4,140,316. String winch 80 differs from the aforementioned winch in the use of a retaining arm 81. Retaining arm 81 is preferably spring-loaded and has one end 82 riding on toothed gear 83 and a finger activated releasing arm 84 at the other end. A full description of its operation is disclosed in the aforementioned patent and need not be discussed further.

A corner block 90 such as shown in FIG. 9 is used to support one set of legs 86 of winch 80 when stringing perimeter strings 91 closest to the corners of the frame 11. Its U-shaped opening 92 makes it easy to install on a frame corner and can be locked in position by means of locking screw 93. A modified corner block is shown in FIG. 10 at reference numeral 94. It is secured on a frame corner 7 by means of matching boss 95 and groove 96.

A stringing rack for use with the present invention is shown at 100, in FIG. 11. It is comprised of a base 101 having a pair of vertically mounted pins 102 protruding from its centre. Pins 102 permit an upright supporting member 103 to be secured to base 101.

A disk 104 having a semi-circular recess 105 is mounted against member 103 and secured thereto by means of spring loaded bolt, washer and wing nut arrangement 106. Bolt head 107 is somewhat recessed into disk 104 to permit attachment of a racquet handle, depicted by broken line 108. The racquet is secured onto disk 104 by using a pair of threaded pins 109 and retaining bar 110. Handle 108 is placed between pins 109 and held in place by tightening wing nuts 111.

This stringing rack allows a racquet to be rotated on an axis, defined by bolt 106, between a position where the racquet is tilted to the left and perpendicular to member 103 and a position where the racquet is tilted to the right and perpendicular thereto.

A stopping pin 112 will rest against disk shoulder 113 when the racquet is to the left and perpendicular to member 103 and will rest against disk shoulder 114 when the racquet is to the right and perpendicular thereto.

When in the upright position, the racquet can be held in place by tightening bolt 106.

Accordingly, the stringing rack will facilitate the stringing of a racquet by permitting the rotation of the racquet through 180° into a proper position without having to remove the racquet from the rack.

Before the racquet can be strung, the length of the strings according to a specified tension has to be determined.

When using a rectangular shaped frame, two strings have to be prepared. One string for the main string tension setting, and one string for the cross string tension setting. This first and second string will give the tension setting for all the main and cross strings required for completing the stringing procedure. We are first required to find the distance required between two knots on a string when the string is in an unstretched condition such that when a string is stretched and the knots positioned in their proper locations on their respective frame members, that string will have a predetermined tension.

Each string will therefore have two knots one of which can be a FIG. 8 knot and the other a half knot. The string length between two knots in the unstretched condition required in order to give a specified tension when stretched, is determined as follows: A first knot (for example figure eight knot) is tied at one end of the length of string, leaving a tail of approximately one inch; this knot is then tightened by means of knot pull 60, holding the string near its opposite end with pliers, the knot can be tightened with a strong steady pull. This knot is fully tightened when the tail end turns at right angle to the string. Tension to tighten the knot should be applied slowly and released slowly as well; a grommet is positioned on the first knot and the string led from the outside to the inside of the bottom frame member 2 in one of the centre string holes and led to and through an opposite hole in the top frame member 1; winch 80 is positioned on the frame immediately above the opposing hole on top of frame member 1 and the string is led through an aperture in the winch key 85 and secured thereto by means of a lightly tightened knot a few inches from the key hole; the string is used to set the tension on the strin9 gauge 70 for the remaining main strings; winch key 85 is slowly turned in order to tension the string, locking the winch key 85, by means of retaining arm 81, from time to time and testing the tension with a string meter (not shown), until the required tension has been reached; with the winch key 85 secured in position at the required tension, a felt marker can be used to place a mark on the string at the point where the string and the top of the frame 87 meet; having marked the string, tension is slowly released, by means of winch key 85, and the string is removed from winch 80 and racquet frame 11. Referring now to FIG. 7, the (figure eight) knot of the marked string is inserted into opening 72 of post 71 of string gauge 70 and the marked end of the string is led along the string gauge 70 and secured between the cone shaped pins 76 of sliding block 73, by forcing the string down between the two pins 76 which abut each other, where an accurate reading from ruler 78 can be taken. This reading will give the distance between the knot position at post 71 and the marked position on the string located at the cone shaped pins 76 thereby giving the length of the unstretched string required between two knots. Making sure the string is tightly pulled with no slack present, block 73 can be locked into position thereby indicating the required distance between two knots for the remaining strings to be measured. The FIG. 8 knot is then removed from opening 72 of post 71, and a half knot is then tied tightly around one of the pins 76. The string ends on either side of the pins are pulled in opposite direction to further tighten the knot around the pin. While proceeding with this step, the string is raised up and pulled clear of the pin and fully tightened using knot pull 60 and pliers. A half knot is thereby achieved at the exact location of the marked position. Using the setting on string gauge 70, all main strings can then be completed in the same manner. A similar procedure can then be followed for setting the tension of the cross strings. If a square frame is used, the tension setting will of course be the same for all main strings and cross strings. A record of the tension gauge settings can be kept for various tensions and various types of strings.

Once a sufficient number of main and cross strings have been prepared, the stringing of the racquet can be completed. Stringing of the racquet can start with two centre main strings followed by two centre cross strings. The strings can then be installed in that order, but alternating from side to side until all strings have been installed. All main strings are installed commencing from the bottom frame member 2 and then secured to the top frame member 1 by means of the winch 80 shown in FIG. 8. Cross strings are then installed, alternating between side members 3 and 4.

As depicted in FIG. 5, the string is led through frame member 44 and through string hole 56. The string is then pulled through an aperture formed by two adjacent string retainers, and attached to a winch secured to the frame (see FIG. 8). The half-knot is pulled under tension through a hole and corresponding aperture by means of the winch. The string tension is then released to lower the knot on the top of the adjacent string retainers. The excess string 57 is then cut away. A similar procedure is then used for the following string hole and corresponding retainer apertures. Each of these knot retaining devices fit snugly within the channel and so require some force to slide within the channel when securing a knot pulled through a string hole and aperture by winch 80. Once the ends of the knot retaining device are raised within the channel means allowing the knot to clear, the cleared ends return to their original position and therefore surround the string directly beneath the knot. The knot is then lowered using winch 80, to ease tension on the string thereby increasing pressure on the knot retainers.

The advantages of this stringing method used in conjunction with a racquet modified as described herein is as follows: (1) all strings are pre-stretched and are of equal length and equal tension; (2) a racquet can be strung without the use of a stringing machine or a professional stringer; (3) a broken or damaged string can be replaced immediately; (4) a broken or damaged string does not noticeably reflect playing efficiency and replacement can be attended to when play is completed; (5) strings all being of equal length and equal tension provide uniform response and maximum efficiency; (6) stringing procedure is both simple and fast; (7) string tensions are limited only by the strength of the racquet frame and strings; (8) greater string concentration can be acquired by reducing the distance between string holes which provides greater string to ball contact which creates ball control and racquet efficiency without the need for high string tension and so reduces the number of broken strings associated with high string tension; (9) less likelihood of damage to strings caused by racquet scraping on ground during play; (10) a wide variety of string choices and types for hybrid stringing; (11) a large sweet spot.

As will be apparent to those skilled in the art in light of the foregoing disclosure, many alterations and modifications are possible in the practise of this invention without departing from the spirit or scope thereof. Accordingly, the scope of the invention is to be construed in accordance with the substance defined by the following claims.

I claim:

1. In a racquet having a plurality of strings, each string having a portion of increased cross-sectional extent near each end, a frame and a handle, the frame having a perimeter, an inside, an outside and a plurality of first apertures extending therethrough, each first aperture having a cross-sectional extent generally the same as the string portions, each string being secured to the frame at two ends, the string portions being located outwardly from the first apertures, the improvement comprising: a retaining channel being defined by parallel spaced apart retaining ridges on the outside of said frame, said retaining ridges generally extending around the perimeter of the frame, string retaining means, adapted to be slidably inserted into the retaining channel so as to be secured to said frame, for preventing said string portions from passing through the first apertures, said string retaining means forming a series of second apertures adapted to be aligned with said first apertures, said second apertures being smaller in cross-section than said string portions such that such string retaining means prevents said portions of said strings from passing throough the first apertures.

2. A racquet as defined in claim 1, the frame having relatively straight top, bottom and side to frame members, each of said top and side frame members including said retaining channel.

3. A racquet as defined in claim 2 wherein said frame is rectangular such that a first set of strings running parallel to each other between said side frame members are of equal length and a second set of strings running parallel to each other but perpendicular to said first set of strings between said top and bottom frame members are also of equal length.

4. A racquet as defined in claim 2 wherein said frame is square such that strings running between said side members and between said top and bottom members are all of equal length.

5. A racquet as defined in claim 4 wherein said frame has relatively flat corners between either of said side members and said top and bottom frame members.

6. A racquet as defined in claim 4 wherein said frame has rounded corners between either of said side members and said top frame members.

7. A racquet as defined in claim 1 wherein said retaining channel forms an integral part of said frame.

8. A racquet as defined in claim 1 wherein said retaining channel means is removably secured to said frame.

9. A racquet as defined in claim 1 wherein said string retaining means comprises a series of generally cross shaped string retainers having resilient ends with a recess located thereon such that the second aperture is formed by said recesses when a resilient end of a first string retainer abuts a resilient end of a second string retainer.

10. A racquet as defined in claim 9 wherein said string retainers include retaining edges for sliding under said retaining ridges such that said resilient ends can be bent outwardly in said open channel between said retaining ridges when one of said string portions is pulled between abutting string retainers, said resilient ends returning to their normal positions once said string portion clears the second aperture.

11. A racquet as defined in claim 1 wherein said string retaining means comprises of generally T-shaped string retainer having a flat first end with thin laterally extending projections and a second end having a recess located thereon, such that the second aperture is formed by said recesses when the second end of one said string retainer abuts the second end of another said string retainer, said projections being adapted to slide under said retaining ridges, said string retainers configured so the abutting second ends of abutting string retainers rotate outwardly about said projection in said open channel between said retaining ridges when said string portion pulled outwardly between abutting second ends of said string retainers.

12. A racquet as defined in claim 1 wherein said string retaining means comprises a flat strip adapted to be slidably inserted in said retaining channel under said retaining ridges, said strip having a series of cut out portions forming opposed resilient string retaining members, each having a free end with a recess located thereon, such that said second aperture is formed by said recesses when said resilient ends lie adjacent to one another, said resilient ends being adapted to bend outwardly in said open channel between said retaining ridges when said string portion is pulled through said second aperture.

13. A method of stringing a racquet having a frame and a handle, said frame having an inside and an outside and retaining channel means with parallel retaining ridges forming an open channel which generally extends along the perimeter of said frame, said frame having a plurality of apertures extending therethrough each aperture having a predetermined cross-sectional extent, comprising the steps of:

sliding string retaining means in said retaining channel means under said retaining ridges, said string retaining means forming a series of apertures smaller in cross-section than said predeterimined cross-sectional extent;

aligning the apertures of said string retaining means with the apertures of said frames;

measuring a length of string to provide a required tension, said string having a portion of cross-sectional extent near each end generally the same as said predetermined cross-sectional extent but larger than the cross-section of the apertures of said string retaining means;

securing at a predetermined aperture on a first side of said frame, a first end of said string;

pulling a second end of said string through an aperture on an opposite side of said frame with a winch positioned on said frame above said aperture and connected to a short length to string extending from the portion of increased extent near the second end.

14. A method as defined in claim 13 wherein said string is provided with portions of increased cross-sectional extent by tying a knot near each end of the string to provide said portions, the knots being spaced apart so that the string will have the required tension when positioned on the frame.

15. A method as defined in claim 13 further comprising the step of positioning a corner block on said frame so as to permit said winch to pull perimeter strings when stringing square and rectangular shape frames having a flat side members and top and bottom frame members and having a flat corner between either of said side members and said top and bottom frame members.

* * * * *